US005338026A

United States Patent [19]

Kregel

[11] Patent Number: 5,338,026

[45] Date of Patent: Aug. 16, 1994

[54] SWING TRAINING UNIT

[76] Inventor: Lane Kregel, 1903 Wisteria, Denton, Tex. 76205

[21] Appl. No.: 64,414

[22] Filed: May 19, 1993

[51] Int. Cl.[5] ..... A63B 69/00; A63B 69/36; A63B 69/38

[52] U.S. Cl. ..... 273/26 E; 273/15 R; 273/29 A; 273/200 R; 273/413

[58] Field of Search ..... 273/1.5 R, 1.5 A, 26 E, 273/29 A, 58 C, 200 R, 200 B, 184 B, 413

[56] References Cited

U.S. PATENT DOCUMENTS

| | | | |
|---|---|---|---|
| 3,194,557 | 7/1965 | Holley | 273/26 E |
| 3,650,530 | 3/1972 | Gantz | 273/1.5 R X |
| 3,716,235 | 2/1973 | Yerkle, Jr. | 273/26 E |
| 3,830,494 | 8/1974 | Biskup | 273/29 A X |
| 3,861,679 | 1/1975 | Culpepper | 273/26 E X |
| 3,934,878 | 1/1976 | Haber | 273/413 |
| 4,632,394 | 12/1986 | Ryan | 273/413 X |
| 4,647,042 | 3/1987 | Bruce | 273/26 E |

FOREIGN PATENT DOCUMENTS

| | | | |
|---|---|---|---|
| 341178 | 1/1931 | United Kingdom | 273/200 R |

*Primary Examiner*—Paul E. Shapiro
*Attorney, Agent, or Firm*—Johnson & Wortley

[57] ABSTRACT

A physical training unit comprising a tethered ball adapted for facilitating practice of a sport swing beneath a basketball hoop. The swinging motion for sporting activities such as baseball, tennis and golf may be addressed by the suspension of a ball from a tether in a configuration simplifying both the installation, removal and retrieval of the tethered ball relative to the hoop. In the present embodiment, the tether is secured at a first, upper end to a hoop mounting means facilitating the suspension of the tether therefrom. A tubular member of defined length is inserted over the tether and permits the pivotal actuation of the tether upon impact of the ball by the user and the limited motion thereof due to interaction with the basketball hoop as well as the limited movement of a free end of the tether relative to the tubular member. In this manner, a variety of athletic swings can be practiced from a conventional basketball hoop assembly.

22 Claims, 3 Drawing Sheets

SWING TRAINING UNIT

BACKGROUND OF THE INVENTION

1. Field of the Invention

The present invention relates to swing training systems and, more particularly, to a tethered ball assembly facilitating the practice of a variety of sport swings.

2. History of the Prior Art

In the sports of tennis, golf, racquetball, baseball and the like it is imperative for the player to practice his or her swing and to develop efficient hand/eye coordination. The most appropriate practice for such hand/eye coordination is the repetitive swinging of the appropriate racket, bat or club along a planned trajectory. Often such practice is facilitated simply by repetitive striking of individual ones of multiple balls used in the particular sporting activity.

In the game of tennis, for example, it is quite conventional to use a plurality of tennis balls held in an upstanding ball hopper. The upstanding hopper is disposed adjacent the player to permit the player easy access to the balls for repetitive practice in hitting of the balls. Unfortunately, when the balls are struck, they are dispersed and must be collected and reassembled in the hopper for subsequent use. The same holds true in the game of golf. Golf balls are normally rented in baskets for placement of individual ones of the balls upon tees or on the ground of a driving range. The balls are driven outwardly on the range to allow the golfer the flexibility of practicing a full golf swing. Again, the golf balls are randomly distributed about the driving range in accordance with the precision by which they were struck. The retrieval of the golf balls thus becomes a major task, albeit one for which driving ranges are generally well suited.

In the game of baseball, batting practice may be accomplished through the use of batting machines or the like. Again hand/eye coordination is critical, and it is necessary to repeatedly practice swinging the bat along the appropriate trajectory in order to enable the player to become accomplished at this particular endeavor. Once struck, the baseball is, of course, driven outwardly away from the user and must be retrieved for subsequent use.

It would be an advantage to provide a swing training system facilitating the practice of sport swings by a user. Such a training system would need to overcome the main disadvantage of prior art practice devices by eliminating the random distribution of miscellaneous balls requiring secondary pickup operations. The present invention provides such a system by facilitating the multiple use of a single ball disposed beneath a conventional basketball hoop. In this manner, batting and swinging practice can be accomplished in conventional sporting areas where basketball hoops are available for the user.

SUMMARY OF THE INVENTION

The present invention relates to sport swinging aides for improving the hand/eye coordination of someone involved in a sporting activity requiring a swinging action. More particularly, the present invention comprises a sport swing training device for use in conjunction with a basketball hoop.

In one aspect, the invention includes a mounting means or mounting plate adapted for engaging a basketball hoop, a support means or tether secured at one end to the mounting plate and supporting a ball at the other end, and a rigid member or tube secured to the tether between the mounting plate and the ball. In this manner, the ball and tube travel through a particular path when the ball is struck with a sport swing. The tube may be secured to the tether by a knot in the tether below the tube. In a further aspect, the lengths of the tether and tube a selected so as to position the ball in a proper location above the ground for the specific type of sport swing to be practiced.

In another aspect, the mounting means is a generally rectangular member having flanges for engaging a basketball hoop. The mounting means can also be formed with a rib recess adapted for receiving the rigid means or tube for facilitating the insertion of the training unit through the basketball hoop. In yet a further aspect, the rigid member or tube is secured to the supporting means or tether in a manner that will allow movement of the tether relative to the tube for the purpose of causing the tube to disengage from the rib recess after the training unit has been inserted through the basketball hoop.

In another aspect, the support means comprises an upper and lower tether. The upper tether secures the rigid member to the mounting means and the lower tether secures the ball to the mounting means.

In another aspect, the above described invention includes apparatus for practicing a baseball swing wherein the ball comprises a baseball and the practice swing comprises a baseball swing. The ball may, in the alternative, comprise a golf ball and the practice swing may comprise a golf swing. Likewise, the ball may be a tennis ball and the practice swing may comprise a tennis swing.

In yet another aspect, the invention comprises a method of practicing a sporting swing with a ball disposed in the vicinity of a basketball hoop. The method includes the steps of providing a ball adapted for being struck by a sport swing, providing a mounting means adapted for engaging basketball hoop, providing and securing a support means or tether, such as a rope, to the mounting means at one end and the ball at the other end, and providing a rigid member, such as a tube, and securing that member to the tether between the mounting means and the ball. The mounting means is then secured to the basketball hoop, and then the sport swing is practiced by striking the ball with the sport swing. The same aspects as incorporated in to the apparatus can be incorporated into the above method.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Figure 1:
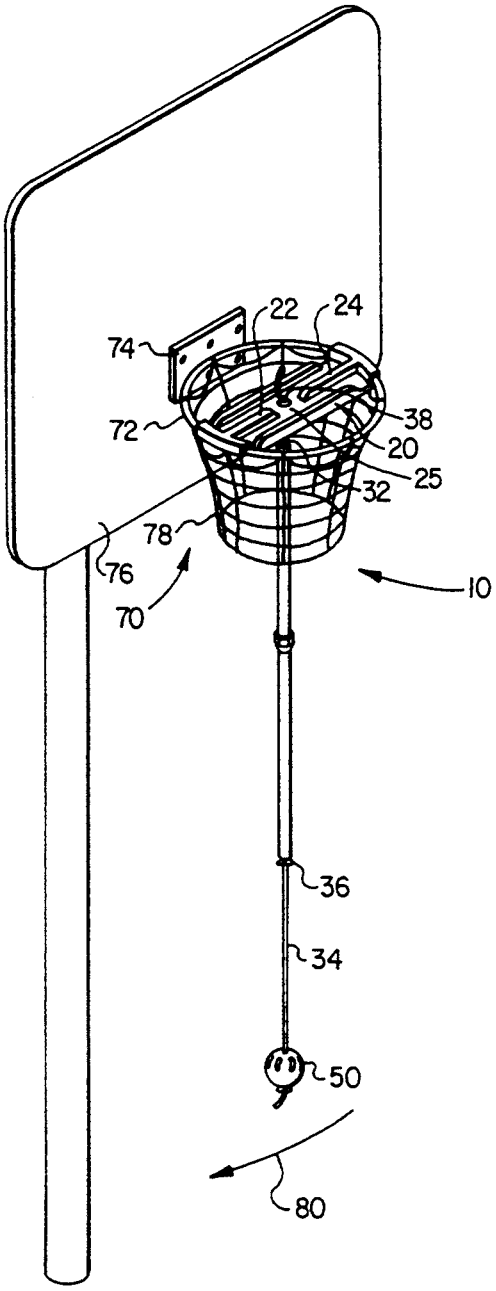
FIG. 1 is a perspective view of one embodiment of the swing training unit of the present invention secured to a conventional basketball hoop.

Referring first to FIG. 1, there is shown a swing training unit or training unit 10 constructed in accordance with the principles of the present invention and suspended from a basketball hoop 70. The basketball hoop 70 is of a conventional design having a rim 72 secured to a backboard 76 by a mounting bracket 74, and a net 78 suspended from the rim 72. The training unit 10 generally comprises a mounting means or mounting plate 20 adapted for attachment to the basketball hoop 70, a rigid member in the form of a tubular member 40, a ball 50, and a support means in the form of an upper tether 32 secured between the mounting plate 20 and the tubular member 40 and a lower tether 34 secured between the tubular member 40 and the ball 50.

Referring still to FIG. 1, the mounting plate 20 of the training unit 10 is oriented away from the mounting bracket 74 of the basketball hoop 70 to facilitate its placement about the round body of the rim 72. The mounting plate 20 is formed with rib recesses 22 and 24 which serve to strengthen the unit and to facilitate its installation upon the rim 72 as described below. Each rib recess 22 and 24 is formed with a hollow region as shown in more detail below. The mounting plate 20 is also formed with an aperture 25 to facilitate receipt of the upper tether 32. The upper tether 32 extends therethrough and is secured by a knot 38, or the like, to afford securement of the assembly.

Still referring to FIG. 1, the upper tether 32 and the lower tether 34, in the present embodiment, are ends of a rope 30. The tubular member 40 extends over the rope 30, leaving the upper tether 32 and the lower tether 34 ends of the rope 30 exposed. A knot 36 is formed in the rope 30 immediately below the tubular member 40 for the purpose of maintaining the position of the tubular member 40 at a finite distance above the ball 50 and in direct association with the basketball hoop 70. As herein shown, any movement of the ball 50 in the direction of arrow 81 will be restricted by the movement of the upper tether 32, the lower tether 34, and the tubular member 40 as described below.

Figure 2:
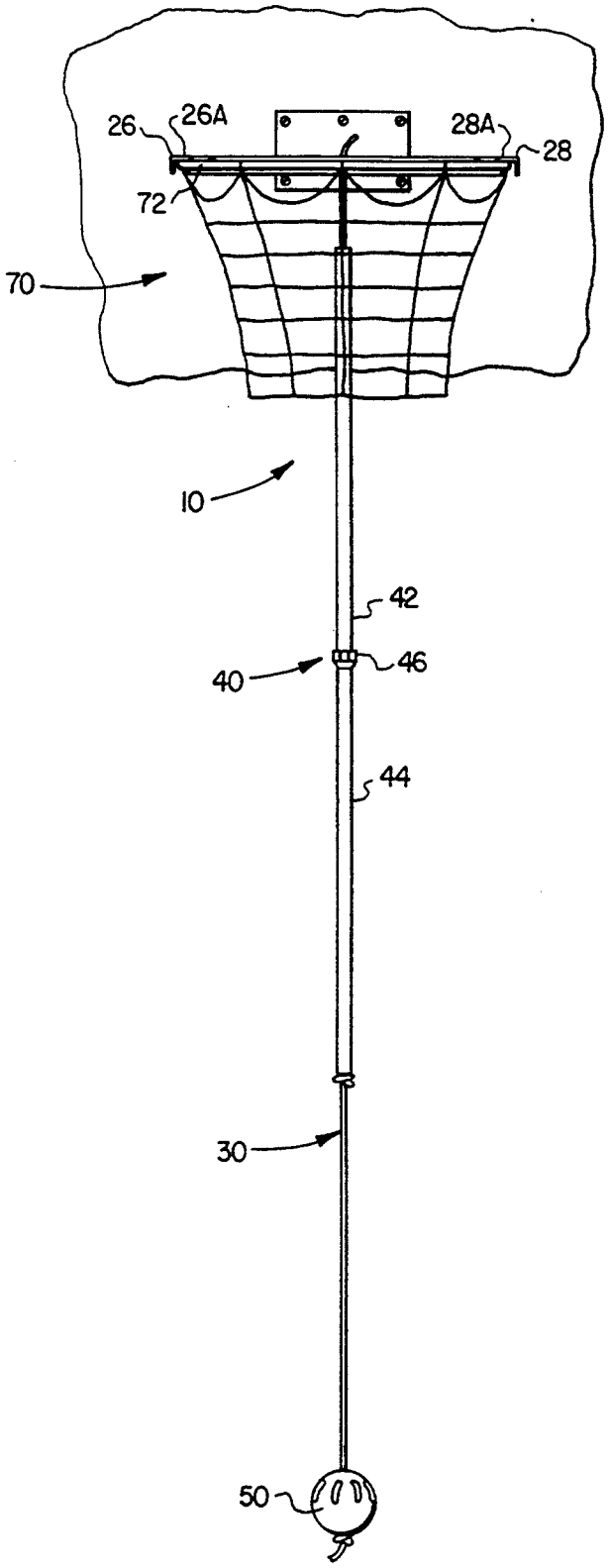
FIG. 2 is an enlarged, front elevational view of the swing training unit of FIG. 1.

Referring now to FIG. 2 there is shown a front elevational view of the training unit 10 of FIG. 1. The rim 72 of the basketball hoop 70 is shown to receive in mating engagement therewith outer lips 26 and 28 of the mounting plate 20. The outer lips 26 and 28 are arcuate in shape and are disposed in generally concentrically spaced relationship from inner lips 26A and 28A disposed inwardly thereof. The arcuate portion between lips 26 and 26A, and, 28 and 28A permit the mounting plate 20 to be secured to the rim 72 in a position facilitating use of the training unit 10. The lips 26 and 26A, and, 28 and 28A aid in keeping the mounting plate 20 secured to the rim 72 during striking of the ball 50. The shape of the mounting plate 20 also aids in the draining of water away from the rope 30.

Still referring to FIG. 2, the rope 30 has disposed thereon the tubular member 40 discussed above. The tubular member 40, in the present embodiment, is constructed of a upper tubular section 42 and a lower tubular section 44, which are joined together by a coupling 46. In the present embodiment, the tubular sections 42 and 44 are formed of PVC pipe and are threadably coupled together. Other materials and coupling techniques could be used. The tubular member 40 facilitates both the installation of the training unit 10 as well as the operation thereof as described in more detail below.

Figure 3:
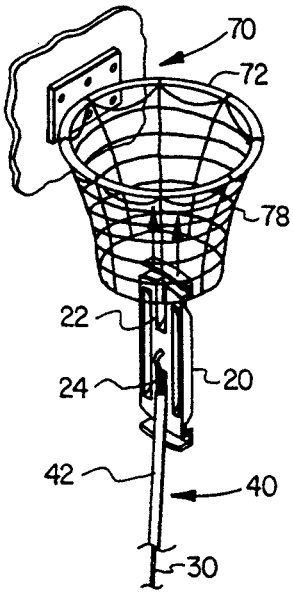
FIG. 3 is a fragmentary perspective view of the first step of the installation into a basketball hoop of a supporting member for the swing training unit of FIG. 1.

Referring now to FIG. 3, there is shown a first step in the installation of the training unit 10 relative to the basketball hoop 70. The mounting plate 20 is disposed in a generally parallel relationship relative to the tubular member 40 wherein the upper tubular section 42 is received within the hollow region of either of the rib recesses 22 and 24 formed therein. The rib recesses 22 and 24 provide both structural strength for the mounting plate 20 as well as a region for securing the upper tubular section 42 thereto. In this particular configuration, the mounting plate 20 may be disposed and temporarily secured in an upright position for passage through the rim 72 and the net 78. Once in this position, the rope 30 may be held with one hand of the user with the tubular member 40 held by the second hand of the user for subsequent securement as described below.

Figure 4:
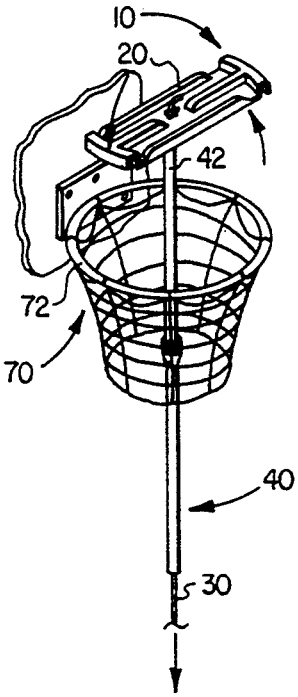
FIG. 4 is a fragmentary perspective view of a second step of the installation as set forth in FIG. 3.

Referring now to FIG. 4, there is shown the second step in the installation of the training unit 10 in the basketball hoop 70. By pulling the rope 30 downwardly relative to the tubular member 40 (shown by arrow), the mounting plate 20 is dislodged from the upper tubular section 42 and it may therein be positioned upon the rim 72 in alignment for the mating engagement therewith shown in FIGS. 1 and 2. Once in alignment, the training unit 10 is lowered and the ball 50 is disposed at the appropriate level for practice.

Figure 5:
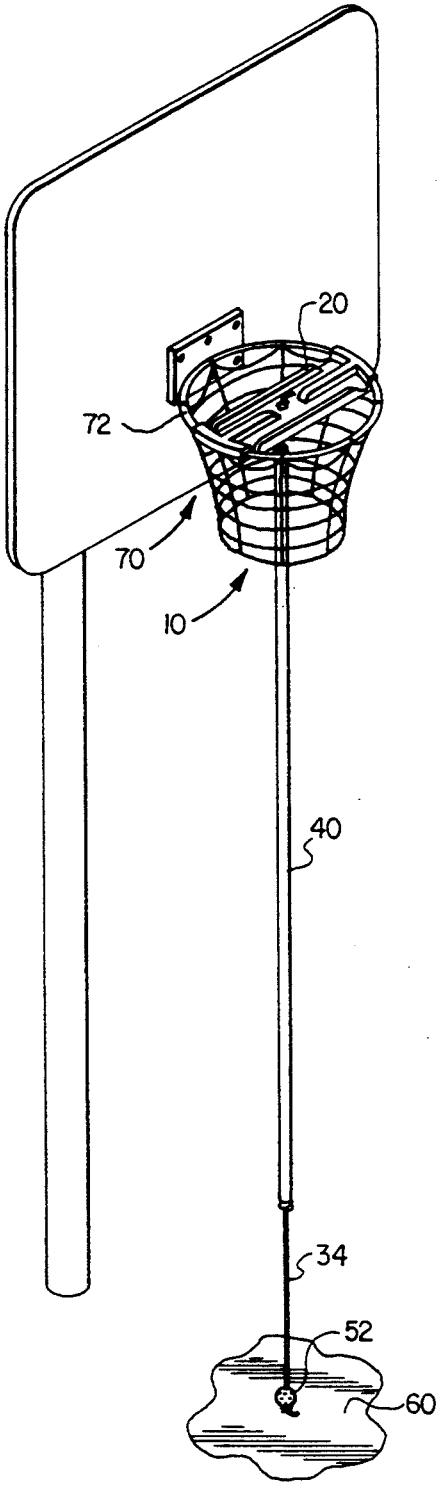
FIG. 5 is a perspective view of an alternative embodiment of the swing training unit of FIG. 1 utilizing a golf ball.

Referring now to FIG. 5 there is shown an alternative embodiment of the training unit 10 of the present invention. In FIG. 5, the mounting plate 20 is shown mounted to the rim 72 of the basketball hoop 70. In this alternative embodiment, a golf ball 52 is disposed at the lower end of the lower tether 34 and adjacent to a ground region 60. The golf ball 52 is an example of but another ball that may be used in conjunction with the present invention for practice of a sport swinging motion. The tubular member 40 in this particular embodiment is a unitary elongated member of generally inflexible construction. Such an elongate member may be made of plastic, wood, metal, or the like providing an element that will respond to the swinging of the ball 50 as described in FIGS. 7A, 7B, and 7C below. It is specifically set forth herein that any stiffening member may be utilized in conjunction with the ball depending therebeneath in accordance with the principles of the present invention. The stiffening member does not need to be a bifurcated tube or a tube of unitary construction, which may also be used.

Figure 6:
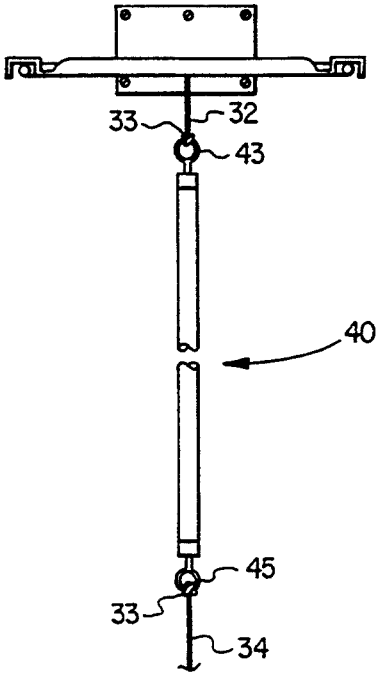
FIG. 6 is a sectional view of an alternative embodiment of the swing training unit of FIG. 1 utilizing eyelets for securing the tubular member and upper and lower tethers.

Referring now to FIG. 6, there is shown sectional view of the tubular member 40, the upper tether 32, and the lower tether 34. In this alternate embodiment, there is no single rope, and the upper tether 32 and the lower tether 34 are separate units. The tubular member has an upper eyelet 43 and a lower eyelet 45 which secure the upper tether 32 and the lower tether 34 by knots 33 and 35, respectively. It is specifically set forth that any means, in accordance with the principles of the present invention, may be utilized for attaching an upper tether and a lower tether to a tubular member. The upper and lower tethers do not need to be part of a single rope, or two separate units, and need not be attached to the tubular member by any particular method. Likewise, in yet another embodiment (not shown) the tether may extend from the mounting plate 20 to the ball 50 while simply being secured at the upper and lower end of the elongate member to provide the functional aspects of the swing as set forth in FIGS. 7A, 7B, and 7C discussed below.

Figure 7A:
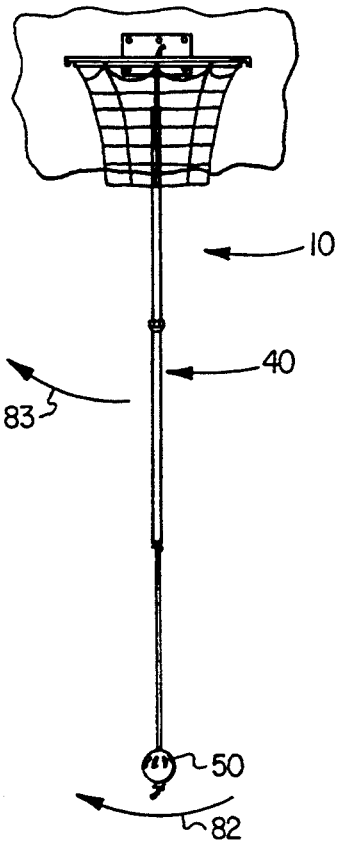
FIGS. 7A, 7B, and 7C are front elevational views of the swing training unit of the present invention illustrating three steps in the striking of a ball suspended therewith.
Figure 7B:
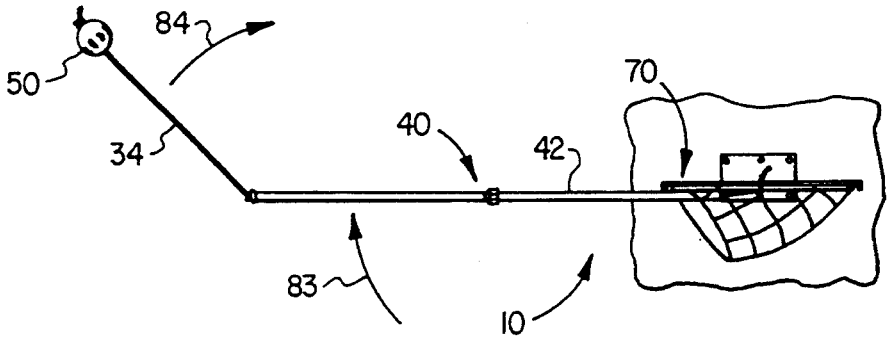
Figure 7C:
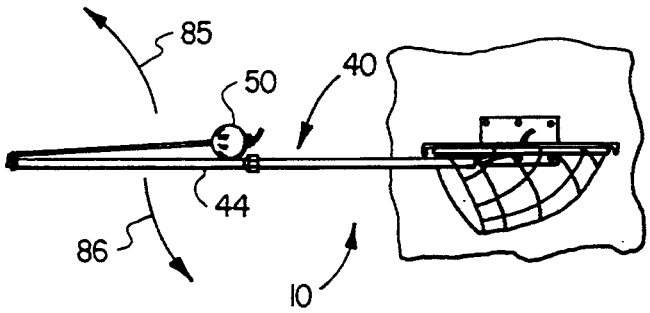

Referring now to FIGS. 7A, 7B, and 7C in combination, the principles of the training unit 10 from FIG. 1 are illustrated in more detail. Referring now to FIG. 7A, the ball 50 has been struck in the direction of arrow 82 wherein the tubular member 40 has been propelled to swing upwardly in the direction of arrow 83. Referring now to FIG. 7B, in this position the tubular member 40 has progressed in the direction of arrow 83 until the upper tubular section 42 of the tubular member 40 has contacted the underneath side of the basketball hoop 70 to therein terminate any further arcuate movement in the direction of arrow 83. The momentum of the ball 50 then carries it and the lower tether 34 in the direction of arrow 84 while the tubular member 40 remains in the position shown. Referring now to FIG. 7C it may be seen that the ball 50 continues after being struck, in the direction of arrow 84 (see FIG. 7B) until it contacts the lower tubular section 44 of the tubular member 40 in response to the striking force thereof. Once the ball 50 has struck the lower tubular section 44, it is repelled upwardly in the direction of arrow 85 while the tubular member 40 falls downwardly in the direction of arrow 86 into the original position shown in the FIG. 7A.

As described above, the training unit 10 permits a variety of balls to be struck by a conventional swinging action. The training unit 10 is constructed for sporting articles such as baseball bats, tennis rackets, racquetball rackets, golf clubs and the like. The training unit 10 restricts the distance of the ball 50 movement and defines a finite ball path allowing the particular ball such as baseball to return to its original position relative to the basketball hoop 70 disposed thereabove for purposes of further use. Repetitive sport swings can thus be performed without the need to locate and collect the balls which are hit. Likewise, the trajectory of the ball which is struck is sufficiently limited and controlled to facilitate ease in use.

It is thus believed that the operation and construction of the present invention will be apparent from the foregoing description. While the method and apparatus shown or described has been characterized as being preferred it will be obvious that various changes and modifications may be made therein without departing from the spirit and scope of the invention as defined in the following claims.

What is claimed is:

1. A sport swing training apparatus for use in conjunction with a basketball hoop, disposed above a ground region, said apparatus comprising:

a mounting plate having an outer lip and an inner lip disposed at each end of said mounting plate and adapted for releasably securing said basketball hoop therebetween;

a ball;

a support means secured to said mounting plate and said ball; and a rigid member secured to said support means between said mounting plate and said ball.

2. The apparatus according to claim 1, wherein said support means and said rigid member are select lengths causing said ball to the suspended from said basketball hoop at a select distance above said ground region appropriate for practicing a swinging action thereon.

3. The apparatus as set forth in claim 1, wherein said support means comprises a single unitary piece of rope.

4. The apparatus as set forth in claim 1, including a means for securing said rigid member to said support means at a select distance from said mounting plate and said ball.

5. The apparatus as set forth in claim 1, wherein said support means comprises a separate upper tether and a separate lower tether, said upper tether securing said rigid member to said mounting plate and said lower member securing said ball to said rigid tether.

6. The apparatus as set forth in claim 5 wherein said upper tether and said lower tether are separate pieces of rope.

7. The apparatus as set forth in claim 1, wherein said rigid member is a tube.

8. The apparatus as set forth in claim 1, wherein said ball comprises a baseball and said practice swing comprises a baseball swing.

9. The apparatus as set forth in claim 1, wherein said ball comprises a golf ball and said practice swing comprises a golf swing.

10. The apparatus as set forth in claim 1, wherein said ball comprises a tennis ball and said practice swing comprises a tennis swing.

11. The apparatus as set forth in claim 1, wherein said ball comprises a racquetball and said practice swing comprises a racquetball swing.

12. A sport swing training apparatus for use in conjunction with a basketball hoop, disposed above a ground region, said apparatus comprising:

a mounting means adapted for engaging said basketball hoop;

a ball;

a support means secured to said mounting means and supporting said ball therefrom;

a rigid member secured to said support means between said mounting means and said ball; and wherein said mounting means comprises a generally rectangular member having basketball hoop engagement flanges formed on opposite ends thereof.

13. A sport swing training apparatus for use in conjunction with a basketball hoop, disposed above a ground region, said apparatus comprising:

a mounting means adapted for engaging said basketball hoop;

a ball;

a support means secured to said mounting means and supporting said ball therefrom;

a rigid member secured to said support means between said mounting means and said ball; and wherein said mounting means is formed with at least one rib recess adapted for receiving said rigid member therein for the securement of said mounting means to said rigid member for facilitating insertion of said mounting means into said basketball hoop.

14. A sport swing training apparatus for use in conjunction with a basketball hoop, disposed above a ground region, said apparatus comprising:

a mounting means adapted for engaging said basketball hoop;

a ball;

a support means secured to said mounting means and supporting said ball therefrom;

a rigid member secured to said support means between said mounting means and said ball;

means for securing said rigid member to said support means at a select distance from said mounting and said ball;

wherein said mounting means includes at least one rib recess adapted for receiving said rigid member therein for the securement of said mounting means to said rigid member for facilitating insertion of said mounting member into said basketball hoop; and wherein said means for securing said rigid member will allow movement between said rigid member and said support means for the purpose of facilitating disengagement of said support means from said rib recess of said mounting means.

15. A sport swing training apparatus for use in conjunction with a basketball hoop, disposed above a ground region, said apparatus comprising:

a mounting means adapted for engaging said basketball hoop;

a ball;

a support means secured to said mounting means and supporting said ball therefrom;

a rigid member secured to said support means between said mounting means and said ball;

wherein said rigid member is a tube; and wherein said tube is bifurcated and includes a means for coupling said bifurcated sections together.

16. A method of practicing a sport swing in the vicinity of basketball hoop disposed above a ground region, said method comprising the steps of:

providing a ball adapted for being struck by said sport swing;

providing a mounting plate having an inner and outer lip at each end of said mounting plate and adapted for securing to said basketball hoop;

providing a support means and securing said support means to said mounting plate and supporting said ball therefrom;

providing a rigid member and securing said rigid member to said support means between said mounting plate and said ball;

securing said mounting plate to said basketball hoop; and striking said ball with said sport swing.

17. The method as set forth in claim 16, wherein said steps of providing a support means and providing a rigid member includes providing said support means and said rigid member with select lengths causing said ball to be suspended from said basketball hoop at a select distance from said ground region.

18. The method as set forth in claim 16, wherein said step of providing and securing said rigid member to said support means includes securing said rigid member to said support means at a select distance from said mounting plate and said ball.

19. The method as set forth in claim 16, wherein:

said step of providing said supporting means includes providing said support means as an independent upper tether and an independent lower tether;

said step of providing and securing said rigid member includes securing an upper section of said rigid member to said mounting plate using said upper tether, and securing said ball to a lower section of said rigid member using said lower tether.

20. A method of practicing a sport swing in the vicinity of a basketball hoop disposed above a ground region, said method comprising the steps of:

providing a ball adapted for being struck by said sport swing;

providing a mounting means adapted for engaging said basketball hoop;

providing a support means and securing said support means to said mounting means and supporting said ball therefrom;

providing a rigid member and securing said rigid member to said support means between said mounting means and said ball;

securing said mounting means to said basketball hoop;

striking said ball with said sport swing; and wherein said step of providing a mounting means includes providing a generally rectangular member having basketball hoop engagement flanges formed on opposite ends thereof.

21. A method of practicing a sport swing in the vicinity of a basketball hoop disposed above a ground region, said method comprising the steps of:

providing a ball adapted for being struck by said sport swing;

providing a mounting means adapted for engaging said basketball hoop;

providing a support means and securing said support means to said mounting means and supporting said ball therefrom;

providing a rigid member and securing said rigid member to said support means between said mounting means and said ball;

securing said mounting means to said basketball hoop;

striking said ball with said sport swing; and wherein said step of providing a mounting means includes providing said mounting means with at least one rib recess adapted for receiving said rigid member therein for the securement of said mounting means to said rigid member for facilitating insertion of said mounting member into said basketball hoop.

22. A method of practicing a sport swing in the vicinity of a basketball hoop disposed above a ground region, said method comprising the steps of:

providing a ball adapted for being struck by said sport swing;

providing a mounting means adapted for engaging said basketball hoop;

providing a support means and securing said support means to said mounting means and supporting said ball therefrom;

providing a rigid member and securing said rigid member to said support means between said mounting means and said ball;

securing said mounting means to said basketball hoop;

striking said ball with said sport swing;

wherein said step of providing and securing said rigid member to said support means includes securing said rigid member to said support means at a select distance from said mounting means and said ball;

wherein said step of providing a mounting means includes providing at least one rib recess adapted for receiving said rigid member therein for the securement of said rigid member to said mounting means for facilitating insertion of said mounting member into said basketball hoop;

wherein said step of providing and securing said rigid member to said support means includes securing said rigid member to said support means so as to allow movement between said rigid member and said support means for the purpose of facilitating disengagement of said support means from said rib recess of said mounting means; and wherein said step of securing said mounting means to said basketball hoop includes the steps of securing said rigid member inside said rib recess of said mounting means, passing said mounting member through said basketball hoop, disengaging said rigid member from said mounting member by causing movement between said rigid member and said support means, and securing said mounting member to said basketball hoop.

* * * * *